US012747652B2

(12) United States Patent
Abdul et al.

(10) Patent No.: US 12,747,652 B2
(45) Date of Patent: Sep. 29, 2026

(54) SUBSEA TERMINATION ASSEMBLY

(71) Applicant: OneSubsea AS, Lysaker (NO)

(72) Inventors: Malik Abdul, Richmond, TX (US); David Hickman, Mobile, AL (US); Kevin Lerch, Mobile, AL (US)

(73) Assignee: OneSubsea AS, Lysaker (NO)

( * ) Notice: Subject to any disclaimer, the term of this patent is extended or adjusted under 35 U.S.C. 154(b) by 33 days.

(21) Appl. No.: 18/851,241

(22) PCT Filed: Mar. 24, 2023

(86) PCT No.: PCT/EP2023/057619
§ 371 (c)(1),
(2) Date: Sep. 26, 2024

(87) PCT Pub. No.: WO2023/186726
PCT Pub. Date: Oct. 5, 2023

(65) Prior Publication Data

US 2025/0198261 A1 Jun. 19, 2025

(30) Foreign Application Priority Data

Mar. 31, 2022 (NO) ..... 20220395

(51) Int. Cl.
*E21B 43/01* (2006.01)
*E21B 41/10* (2006.01)

(52) U.S. Cl.
CPC ..... *E21B 43/0107* (2013.01); *E21B 41/10* (2013.01)

(58) Field of Classification Search
CPC ..... E21B 43/013; E21B 33/0387; E21B 43/0107; E21B 41/10; E21B 41/0007; E21B 33/038; F16L 1/235; F16L 1/26
See application file for complete search history.

(56) References Cited

U.S. PATENT DOCUMENTS 3,032,125 A * 5/1962 Hiser ..... E21B 17/01 166/359
3,486,556 A * 12/1969 Burgess ..... E21B 33/0387 285/120.1

(Continued)

FOREIGN PATENT DOCUMENTS

WO WO-2010009510 A1 * 1/2010 ..... E21B 43/013

OTHER PUBLICATIONS

Norwegian Search Report for Application NO 20220395 date Oct. 27, 2022.

(Continued)

*Primary Examiner* — Edwin J Toledo-Duran
(74) *Attorney, Agent, or Firm* — Kyle R. Miiller

(57) ABSTRACT

A subsea termination assembly comprising a main body, a stab pin with a stabbing end for guiding of the subsea termination assembly during landing on a receiving subsea structure, and a hinge assembly connecting the stab pin to the main body. The subsea termination assembly comprises a connected portion that is pivotably attached to the main body with the hinge assembly. The stab pin comprises a free portion and the free portion comprises the stabbing end. The subsea termination assembly comprises a stab pin connection arrangement, detachably connecting the free portion to the connected portion. A method is also disclosed.

18 Claims, 6 Drawing Sheets

(56) References Cited

U.S. PATENT DOCUMENTS 3,685,004 A * 8/1972 Kerr ..... H01R 13/523 439/314
3,713,414 A * 1/1973 Wischhoefer ..... B63C 7/16 114/295
3,874,706 A * 4/1975 Arnold ..... F16L 19/08 285/24
3,956,834 A * 5/1976 McWatters ..... E02F 3/905 37/417
4,223,920 A * 9/1980 Van Bilderbeek .... E21B 43/013 285/24
4,541,753 A * 9/1985 Langner ..... E21B 43/013 405/169
4,671,702 A * 6/1987 Langner ..... F16L 1/24 72/369
4,676,696 A * 6/1987 Laursen ..... F16L 1/26 405/169
4,702,321 A * 10/1987 Horton ..... E02D 23/00 114/264
4,867,605 A * 9/1989 Myers ..... E21B 41/10 166/341
4,877,356 A * 10/1989 Bontenbal ..... F16L 37/002 166/341
5,092,711 A * 3/1992 Langner ..... E21B 19/002 166/359
5,209,673 A * 5/1993 Mohn ..... E21B 33/0385 439/191
5,320,175 A * 6/1994 Ritter ..... E21B 43/013 166/347
5,890,841 A * 4/1999 Friis ..... H02G 1/10 405/173
6,098,715 A * 8/2000 Seixas ..... E21B 33/0387 166/347
6,220,303 B1 * 4/2001 Secher ..... E21B 43/0135 138/109
6,390,190 B2 * 5/2002 Mullins ..... E21B 21/01 175/218
6,409,428 B1 * 6/2002 Moog ..... E21B 43/0107 405/172
6,742,594 B2 * 6/2004 Langford ..... E21B 43/40 166/368
7,032,673 B2 * 4/2006 Dezen ..... B01D 17/12 166/341
7,044,228 B2 * 5/2006 Langford ..... E21B 43/40 166/350
7,373,986 B2 * 5/2008 Pollack ..... F16B 21/04 166/359
7,621,698 B2 * 11/2009 Pallini, Jr. ..... B63B 21/502 405/223.1
7,628,568 B2 * 12/2009 Critsinelis ..... E21B 17/01 405/173
7,794,177 B2 * 9/2010 DeLack ..... F16L 1/26 405/172
7,866,398 B2 * 1/2011 Barratt ..... H02G 1/10 166/347
7,967,070 B2 * 6/2011 Reddy ..... F16L 1/123 166/341
8,056,634 B2 * 11/2011 Spencer ..... E21B 33/038 166/344
8,057,121 B2 * 11/2011 Gallagher ..... F16B 21/04 403/349
8,425,154 B1 * 4/2013 Lugo ..... F16L 1/26 166/347
8,430,170 B2 * 4/2013 Pionetti ..... E21B 17/015 166/368
8,550,169 B2 * 10/2013 Mckay ..... E21B 33/038 166/344
8,573,305 B2 * 11/2013 Reddy ..... E21B 17/017 166/341
8,919,447 B2 * 12/2014 Thuet ..... B63B 21/502 166/341
8,961,070 B1 * 2/2015 Mascarenhas ..... F16L 1/26 405/170
9,163,485 B2 * 10/2015 White ..... E21B 43/013
11,982,385 B2 * 5/2024 Maldaner ..... E21B 41/0007
2004/0140125 A1 * 7/2004 Dezen ..... B01D 17/06 166/348
2004/0226722 A1 * 11/2004 Colyer ..... E21B 41/04 166/360
2008/0286050 A1 * 11/2008 DeLack ..... E21B 43/013 405/172
2010/0038090 A1 * 2/2010 Barratt ..... H02G 1/10 166/341
2010/0196101 A1 * 8/2010 Pose ..... F16L 1/26 405/170
2014/0352972 A1 * 12/2014 Gutierrez ..... E21B 41/04 166/335
2019/0271132 A1 * 9/2019 Meling ..... E02D 23/16
2022/0364663 A1 * 11/2022 Maldaner ..... E21B 41/0007

OTHER PUBLICATIONS

Umbilical Termination Assembly Brochure from Oceaneering.com (2016).

Ellisor, R. W.; Martyniak, P. J.; Wilson, J. V. C. "Canyon express deepwater umbilical and control system: design and installation" OTC paper presented at the 2003 Offshore Technology Conference in Houston, TX. Paper No. 15099 (2003).

* cited by examiner

SUBSEA TERMINATION ASSEMBLY

PRIOR RELATED APPLICATIONS

The present application is a national entry of PCT Application No. PCT/EP2023/057619, filed on Mar. 24, 2023, which claims priority under the Paris Convention to Norwegian Application No. NO20220395, filed on March 31,2022. The entire contents of such prior applications are incorporated by reference herein.

TECHNICAL FIELD

The present invention relates to a subsea termination assembly configured to land on a support at the seabed.

BACKGROUND ART

When installing electric power cables, fluid lines, umbilicals, and the like on the seabed, it is common to provide them with a guiding means at their end to facilitate correct installation. A termination assembly will typically be provided at the end, and the guiding means can be attached to the termination assembly.

When landing some types of subsea equipment on the seabed, a pre-installed guidepost extends vertically upwards, and a receiving guide funnel arranged on the equipment receives the guidepost.

When installing subsea umbilicals, it is known to provide the umbilical termination assembly (UTA) with a downwardly extending stab pin, which is received by a guide funnel already installed at the seabed. Such a solution is shown in FIG. 1 and FIG. 2 of publication EP2172616. Once the stab pin has landed in the receiving funnel, the UTA is rotated from its initial vertical orientation, into its final horizontal orientation. This rotation is enabled by a hinge arrangement connecting the UTA and the stab pin.

Patent publication U.S. Pat. No. 5,320,175 discloses a solution for installation of a subsea jumper. At each end of the jumper, there is provided a downwardly extending stab. The stabs are inserted into two receiving stab receptacles. This provides correct location of the jumper ends. Moreover, the jumper ends are connected to the stabs with a hinge, such that after landing, the jumper ends can take a substantially horizontal orientation after having been lowered down with a vertical orientation.

Moreover, WO2010009510 discloses a tool and a method for installing free connector hubs of subsea flowlines to enable a clamping device to be fitted thereto.

When installing various types of cables, fluid lines, umbilicals, and the like on the seabed, it is common to use a laying vessel with a tensioner system. The tensioner system holds onto the cable (or the like) while paying it out into the sea in a controlled manner. Before such operation can start, the cable, umbilical or the like, must be installed in the tensioner system. In some cases, it also needs to be inserted through other types of equipment or parts of the surface vessel. In some situations, the stab pin may act as a snagging point and it may be cumbersome to install the cable or umbilical or the like with the tensioner system while the stab pin is connected to the termination assembly. This is alleviated by removing the stab pin and re-mounting it when the cable, umbilical or the like has been installed in the tensioner.

This process involves a significant use of time. Moreover, it involves safety risks, as the stab pin and the components attaching the stab pin to the termination assembly are heavy components.

An object of the present invention may be to reduce one or more of the said problems.

SUMMARY OF INVENTION

According to a first aspect of the present invention, there is provided a subsea termination assembly comprising a main body, a stab pin with a stabbing end for guiding of the subsea termination assembly during landing on a receiving subsea structure, and a hinge assembly that connects the stab pin to the main body. The subsea termination assembly has a connected portion that is pivotably attached to the main body with the hinge assembly. The stab pin comprises a free portion and the free portion comprises the stabbing end. Moreover, the subsea termination assembly comprises a stab pin connection arrangement by means of which the free portion is detachably connected to the connected portion.

With such a subsea termination assembly, the stab pin, or alternatively a part of the stab pin, can easily be removed from the subsea termination assembly before going through the tensioner and when preparing the subsea termination assembly for being lowered towards the seabed. After such preparation, the stab pin can be re-installed to the subsea termination assembly before said lowering commences.

The stabbing end of the free portion is configured to be inserted into a guide funnel at the seabed.

In some embodiments, the connected portion or the free portion, respectively, comprises an insert section that is insertable into a bore of the free portion or the connected portion, respectively. Moreover, the stab pin connection arrangement can further comprise securing means, for instance securing bolts or pins, for securing the connected portion and the free portion when in the inserted state.

Advantageously, the subsea termination assembly can further comprise an angular pin alignment arrangement that is configured to angularly align the free portion to the connected portion. Typically, the angular pin alignment arrangement can comprise an alignment pin and a notch on the free portion and the connected portion, or vice versa, to facilitate correct attachment of the free portion to the connected portion.

In some embodiments, the hinge assembly can comprise a trunnion pin which is attached to the main body. Moreover, the stab pin and a yoke can be connected to the trunnion pin, such that both the yoke and the stab pin can pivot about the trunnion pin.

Advantageously, the yoke comprises a lifting eye configured for interfacing with a lifting means, such as a crane.

In some embodiments, a subsea umbilical can be connected to the subsea termination assembly. The subsea termination assembly will then be a subsea umbilical termination assembly (SUTA).

The free portion can in some embodiments comprise a landing plate. The landing plate is configured to halt the insertion of the stab pin into the guide funnel. This ensures correct vertical position of the pivot point during pivoting of the main body.

According to a second aspect of the invention, there is provided a method of installing a subsea termination assembly with a main body, at a subsea location. The method comprises the following steps:

a) at a floating structure, for instance a vessel, installing a utility string, which is connected to the main body, in a tensioning system;
b) attaching a free portion of the stab pin to a connected portion, wherein the connected portion is attached to the main body with a hinge assembly;

c) lowering the termination assembly from the floating structure towards the seabed;

d) at the seabed, inserting a stab pin, which is attached to the main body through the hinge assembly, into a guide funnel;

e) pivoting the main body with respect to the stab pin, thus landing the main body onto a receiving subsea structure.

With the term utility string is meant a string with a function other than or in addition to transferring mechanical forces, such as transfer of signals, electric power, or fluid, or a combination of such functions, such as an umbilical.

In some embodiments, the connected portion can be formed as a part of the stab pin. In other embodiments, the connected portion can be for instance an attachment means that does not constitute a part of the stab pin and that is configured for attachment of the free portion of the stab pin to the hinge assembly.

In some embodiments, step b) can comprise inserting an insert section of the connected portion or the free portion, respectively, into a bore of the free portion or the connected portion, respectively, and then securing the free portion to the connected portion with a securing means.

In some embodiments, the utility string can be a subsea umbilical.

Moreover, in some embodiments, step c) may comprise suspending the subsea termination assembly through a yoke with a lifting eye, wherein the yoke is configured to pivot, with respect to the main body, about the same pivot axis as the stab pin.

With the term subsea umbilical is meant a string comprising at least two of the following types of transmission: electric power transmission, fluid transmission, optical signal transmission, and electric signal transmission. With the term electric power transmission is meant transmission of electric power of more than 10 KW. Thus, for instance, a subsea umbilical according to the meaning herein can comprise power cores for transferring electric power of more than 10 KW, and further comprise a fluid tube, such as for transmission of chemicals (e.g. MEG) or hydraulic pressure.

According to a third aspect of the present invention, there is provided a subsea termination assembly comprising a main body, a stab pin with a stabbing end for guiding of the subsea termination assembly during landing on a receiving subsea structure, and a hinge assembly connecting the stab pin to the main body in a pivotable manner. The subsea termination assembly further comprises a yoke with a lifting eye. According to the third aspect of the invention, the hinge assembly comprises a trunnion pin which is attached to the main body. The stab pin and the yoke are connected to the trunnion pin, such that the yoke and the stab pin can pivot about the trunnion pin. In this manner, the yoke and the stab can both pivot with respect to the main body, about a common pivot axis.

A subsea termination assembly of the type presented herein can be connected to both end of a utility string, such as an umbilical, power cable or the like.

DETAILED DESCRIPTION OF THE INVENTION

While various features of the invention have been discussed in general terms above, a more detailed and non-limiting example of embodiment will be presented in the following with reference to the drawings, in which FIG. 1 is a schematic view of a floating vessel lowering a subsea umbilical termination assembly (SUTA) towards the seabed;

Figure 1:
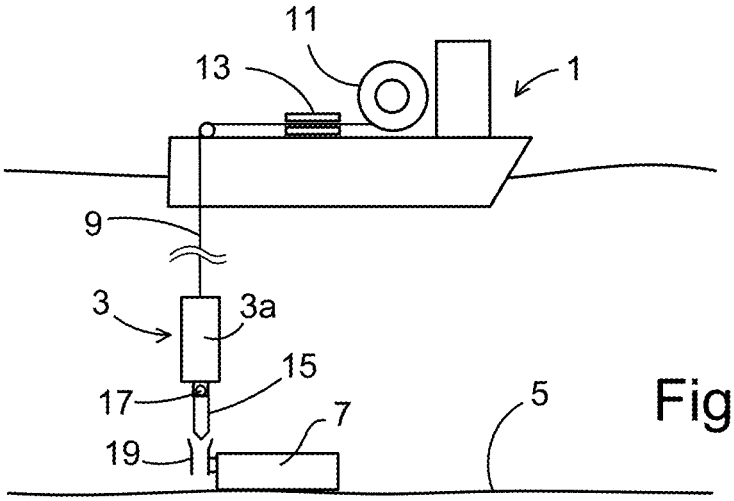

FIG. 1 depicts a floating structure 1, such as a vessel, which is about to land a subsea umbilical termination assembly (SUTA) 3 at the seabed 5. At the seabed 5, there is already installed a receiving structure 7, which is configured to receive the SUTA 3. The SUTA 3 is arranged at one end of an umbilical 9. The umbilical 9 can typically be reeled off from a bobbin 11 on the floating structure 1, through a tensioner 13 which is used to control the release of the umbilical 9 into the sea.

To the lower end of the SUTA 3, there is arranged a stab pin 15. The stab pin 15 is connected to a main body 3*a* of the SUTA 3 through a hinge assembly 17. Thus, the stab pin 15 can pivot with respect to the main body 3*a*.

The stab pin 15 is configured to enter a guide funnel 19 that is attached to the receiving structure 7. Thus, when landing the SUTA 3, the stab pin 15 is guided into the guide funnel 19, typically with the aid of an ROV (not shown). When the stab pin 15 has landed inside the guide funnel 19, the main body 3*a* pivots with respect to the stab pin 15, and lands in a guided manner on the receiving structure 7.

Figure 3:
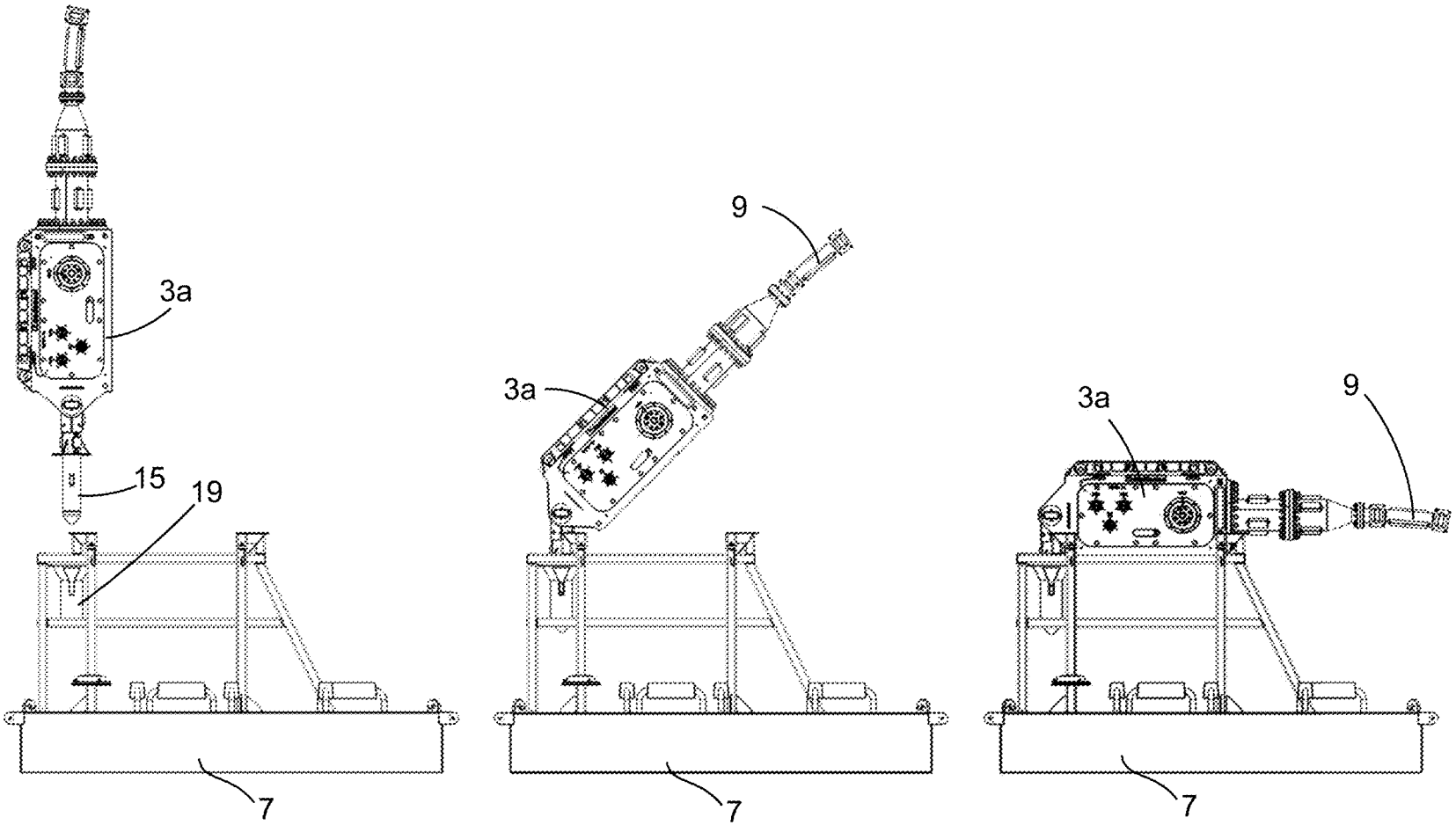
FIG. 3 is a more realistic illustration of the SUTA pivoting in a guided manner, to land on the receiving frame.

FIG. 3 depicts three images of a more realistic embodiment of the SUTA 3. The three images show, from the left towards the right,

- a situation immediately before the stab pin 15 enters the guide funnel 19;
- a situation wherein the stab pin 15 has fully entered the guide funnel 19 and the main body 3*a* has started to pivot towards the receiving structure 7; and
- a situation wherein the main body 3*a* has landed fully on the receiving structure 7.

To prepare the lowering of the SUTA 3 (cf. FIG. 1) from the floating structure 1, the umbilical 9 must be installed in the tensioner 13. This is a cumbersome process if performed while the stab pin 15, which may represent a snagging point, is still attached to the main body 3*a* of the SUTA 3. Consequently, it is common to temporarily remove the stab pin 15 during such preparation.

Figure 4:
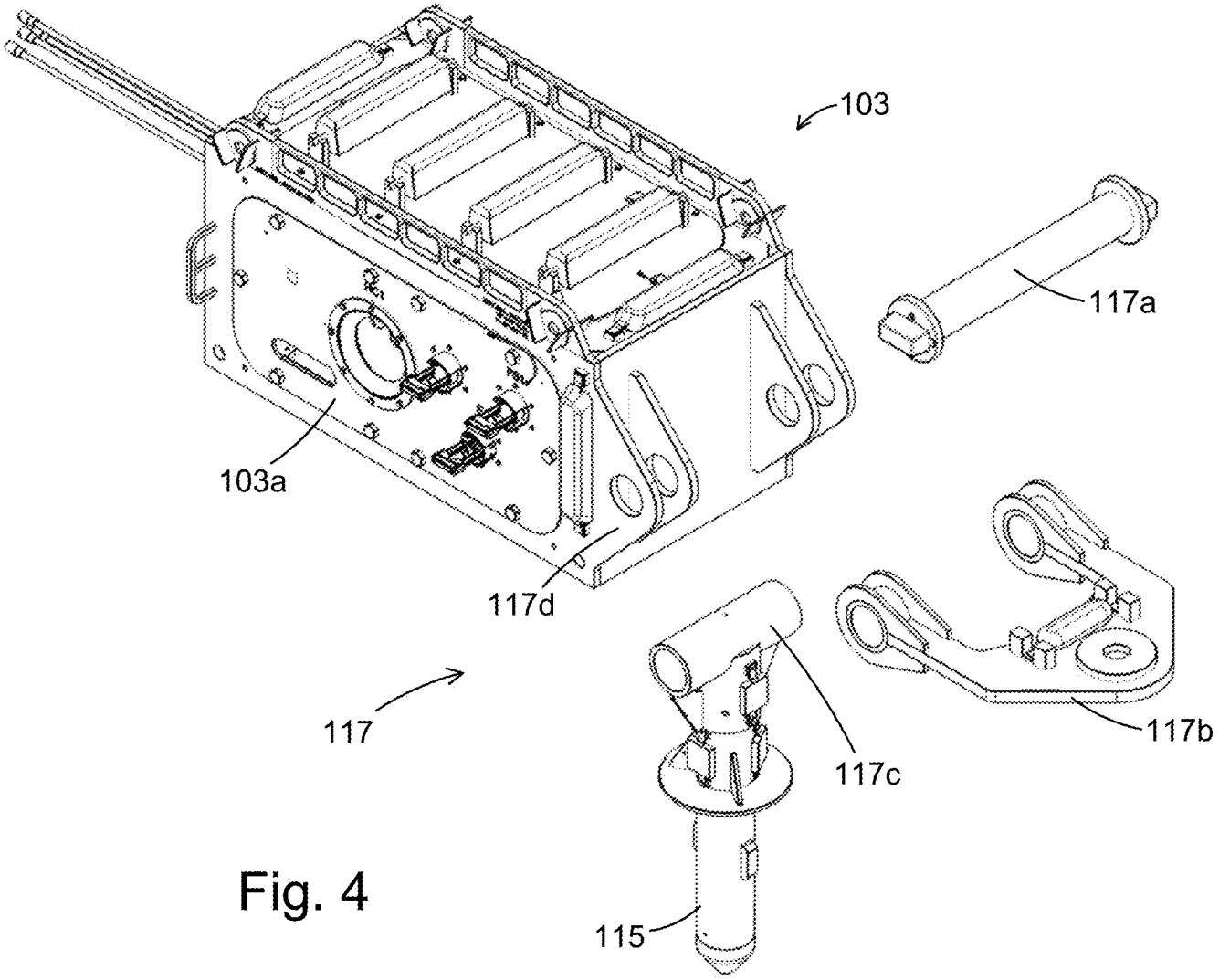
FIG. 4 is a perspective view of a SUTA, having a detachable stab pin, however not according to the present invention.

FIG. 4 depicts a SUTA 103 of an embodiment which is not according to the present invention. To remove the stab pin 115 from the main body 103*a*, the operator needs to pull out a trunnion pin 117*a* from its interface (in apertures of hinge brackets 117*d*) with main body 103*a*. Also connected to the trunnion pin 117*a*, when in the assembled state, is a yoke 117*b*. To the stab pin 115 there is connected a trunnion-receiving sleeve 117*c*. When in the assembled state, the trunnion pin 117*a* extends through the trunnion-receiving sleeve 117*c*. The components of this hinge assembly 117 are large and heavy and require considerable time and heavy equipment for disassembly and later re-assembly.

Figure 2:
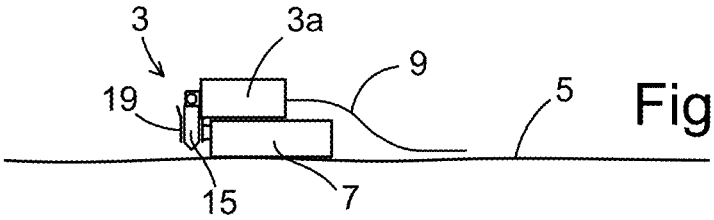
FIG. 2 is a schematic view illustrating the SUTA having landed on a receiving frame at the seabed.
Figure 5:
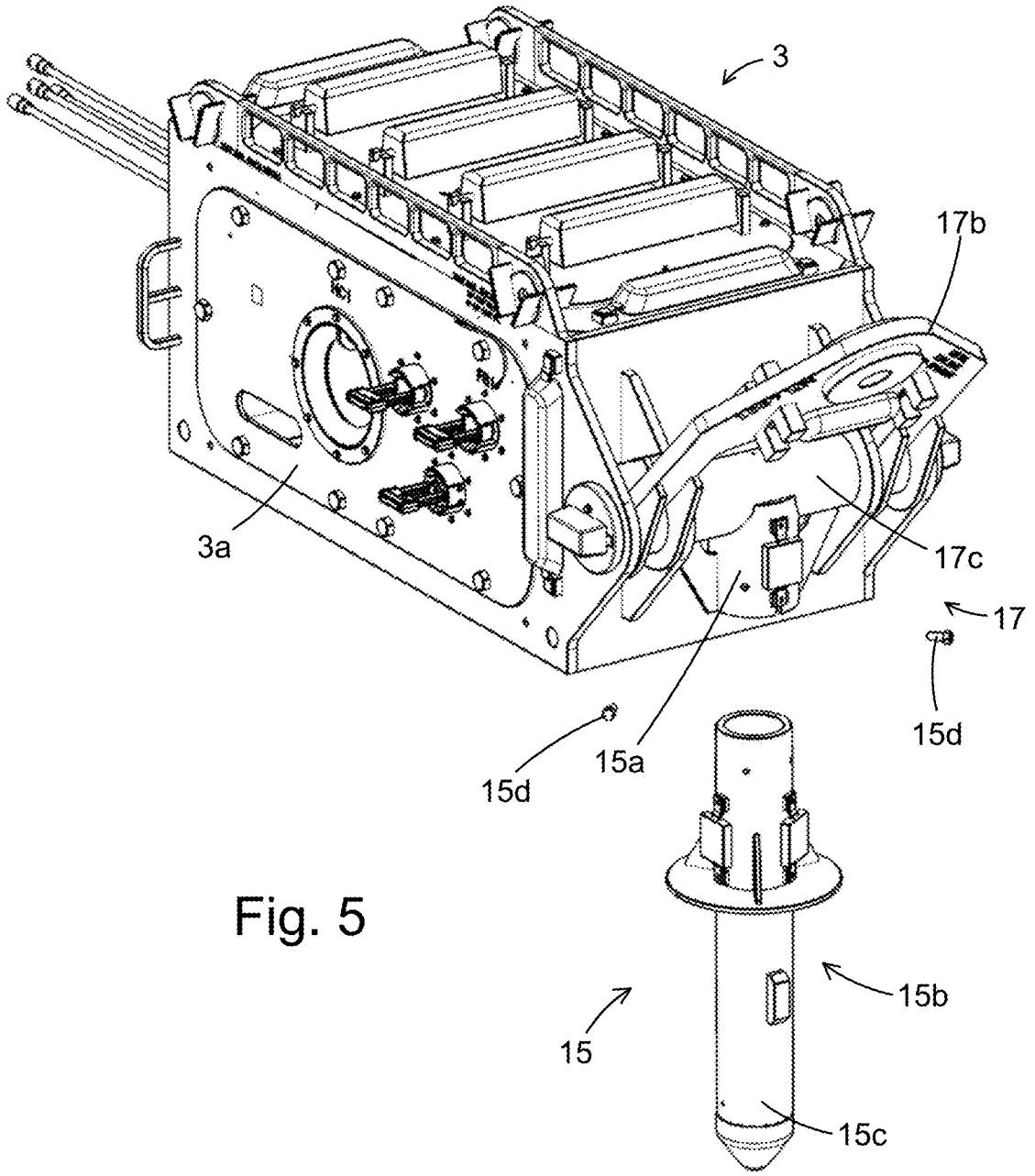
FIG. 5 is a perspective view of a SUTA according to the present invention, also having a detachable stab pin.

An improved solution is shown in FIG. 5, which depicts a solution according to the present invention. The stab pin 15 comprises a connected portion 15*a*, which is attached to the hinge assembly 17. The stab pin 15 further comprises a free portion 15*b*. The free portion 15*b* has a stabbing end 15*c*, configured to be inserted into the guide funnel 19 (cf. FIG. 1 to FIG. 3). The free portion 15*b* is detachable from the connected portion 15*a*.

The free portion 15*b* can be maintained in an attached state, where it is attached to the connected portion 15*a*, by means of a set of securing bolts 15*d*.

Figure 6:
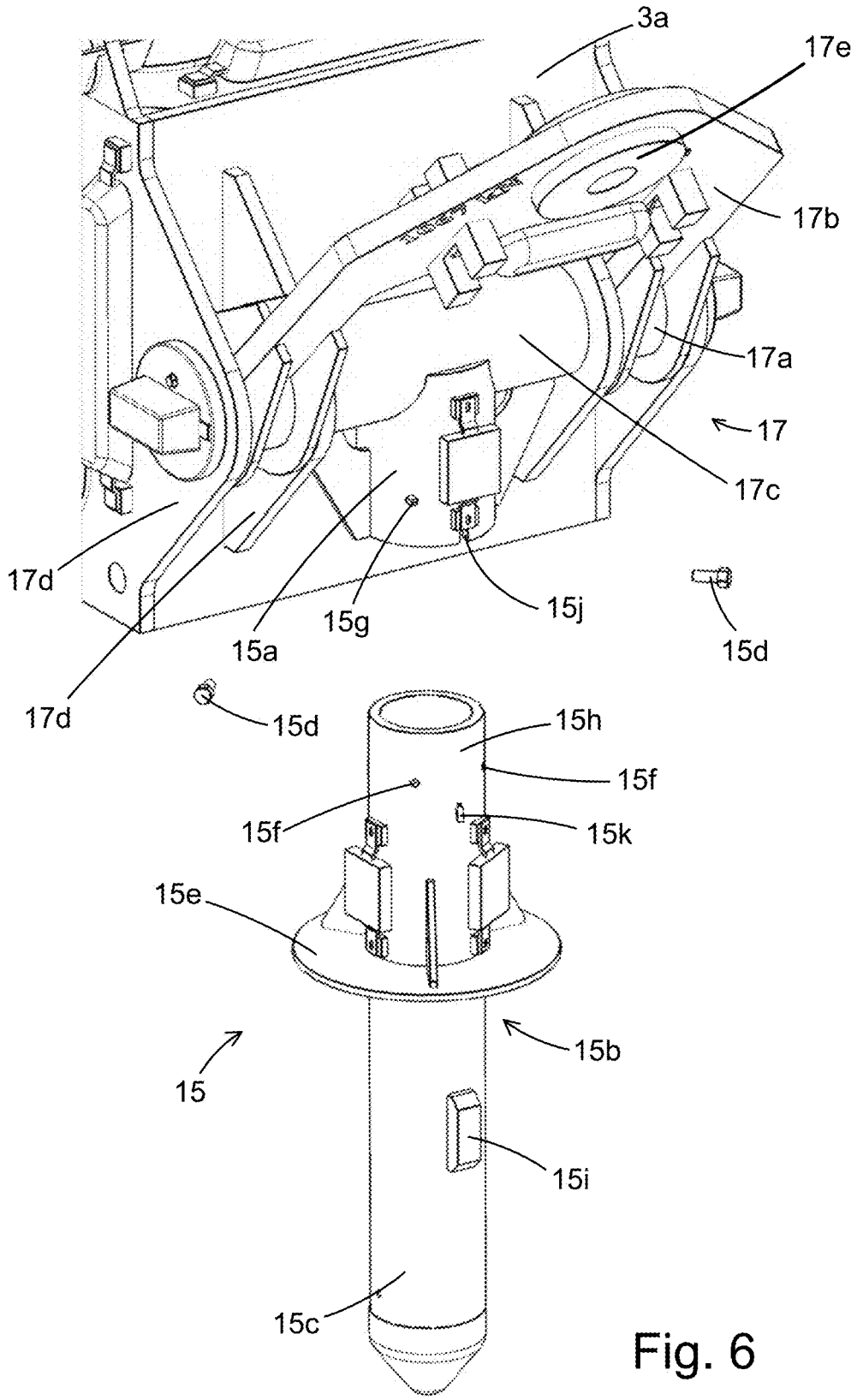
FIG. 6 is an enlarged view of a portion of FIG. 5.

Reference is also made to FIG. 6, which depicts an enlarged portion of FIG. 5. The free portion 15*b* of the stab pin 15 has a landing plate 15*e*, configured to abut against an upper portion of the guide funnel 19 when fully inserted.

The part of the free portion 15*b* that is opposite the stabbing end 15*c* comprises an insert section 15*h* that can be inserted into a bore of the connected portion 15*a* of the stab pin 15. When in the inserted state, it is secured by means of the securing bolts 15*d*. The securing bolts 15*d* are inserted through first securing apertures 15*f* in the free portion 15*b*, which are aligned with second securing apertures 15*g* in the connected portion 15*a*. In other embodiments, a section of the connected portion 15*a* could be insertable into a part of the free portion 15*b*.

Hinge brackets 17*d*, which are attached to the main body 3*a*, comprise apertures through which the trunnion pin 17*a* extends. The yoke 17*b* and the stab pin 15, i.e. the connected portion 15*a*, connect to and pivot about the trunnion pin 17*a*.

The yoke 17*b* is typically used as a lifting interface when maneuvering the SUTA 3 on the surface structure 1. The yoke 17*b* has a lifting eye 17*e*, where a lifting means can connect.

In the embodiment shown in FIG. 6, the connected portion 15*a*, which is configured to receive the insert section 15*h*, comprises an alignment notch 15*j* at its lower edge. The alignment notch 15*j* is configured to receive an alignment protrusion 15*k* that is arranged on the insert section 15*h*. This ensures correct angular alignment between the free portion 17*b* and the connected portion 15*a*. The alignment notch 15*j* and the alignment protrusion 15*k* constitute an angular pin alignment arrangement.

Figure 7:
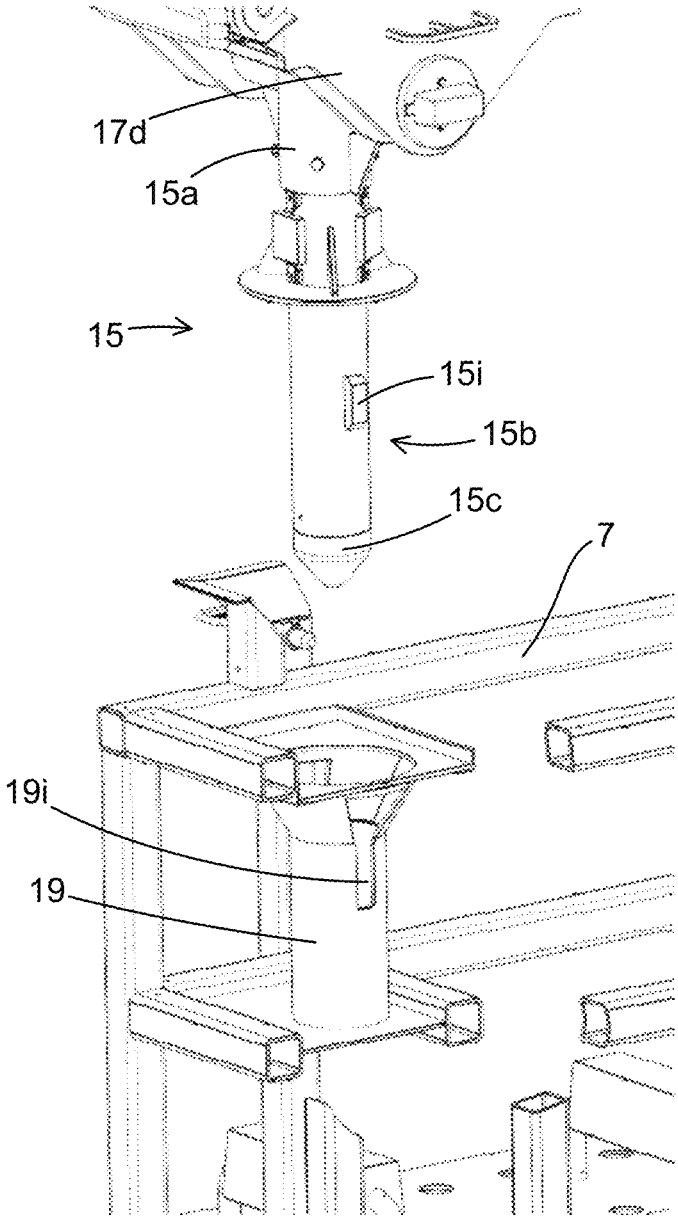
FIG. 7 is a perspective view of a detachable stab pin immediately before being stabbed into a receiving guide funnel subsea.

Reference is now made to FIG. 7, which shows the situation corresponding to the one shown in FIG. 1. The free portion 15*b* of the stab pin 15 comprises guide means 15*i* configured to rotationally align the stab pin 15 with engaging funnel guide means 19*a* in the guide funnel 19. The guide means 15*i* is, in the shown embodiment, located between the landing plate 15*e* and the stabbing end 15*c*.

The invention claimed is:

1. A subsea termination assembly comprising a main body, a stab pin with a stabbing end configured to be inserted into a guide funnel of a receiving subsea structure to guide the subsea termination assembly during landing on the receiving subsea structure, and a hinge assembly connecting the stab pin to the main body, wherein:

the stab pin comprises a connected portion that is pivotably attached to the main body with the hinge assembly and a free portion that comprises the stabbing end of the stab pin, and the subsea termination assembly comprises a stab pin connection arrangement detachably connecting the free portion of the stab pin to the connected portion of the stab pin, wherein the stab pin connection arrangement comprises:

an insert section disposed within a bore along a central axis of the bore, wherein a first one of the connected portion of the stab pin or the free portion of the stab pin has the insert section, and a second one of the connected portion of the stab pin or the free portion of the stab pin has the bore; and one or more bolts or pins configured to extend through one or more first securing apertures in the free portion of the stab pin and one or more second securing apertures in the connected portion of the stab pin to block relative movement and separation of the connected portion of the stab pin and the free portion of the stab pin, wherein the one or more first securing apertures are angularly aligned with the one or more second securing apertures.

2. The subsea termination assembly according to claim 1, wherein the hinge assembly comprises a trunnion pin which is attached to the main body, and the stab pin and a yoke are connected to the trunnion pin, such that the yoke and the stab pin can pivot about the trunnion pin.

3. The subsea termination assembly according to claim 2, wherein the yoke comprises a lifting eye configured to interface with a lift.

4. The subsea termination assembly according to claim 1, wherein the main body is connected to an end of an umbilical configured to transmit electrical signals and fluid.

5. The subsea termination assembly according to claim 1, further comprising an angular pin alignment arrangement configured to angularly align the free portion of the stab pin to the connected portion of the stab pin, wherein the angular pin alignment arrangement comprises an alignment protrusion that fits into an alignment slot or notch, and wherein the alignment protrusion and the alignment slot or notch are configured to engage one another in an axial direction over an axial distance along the central axis of the bore during axial engagement between the free portion of the stab pin and the connected portion of the stab pin.

6. The subsea termination assembly according to claim 1, wherein the one or more bolts or pins are configured to extend in a radial direction relative to the central axis of the bore through the one or more first securing apertures in the free portion of the stab pin and the one or more second securing apertures in the connected portion of the stab pin.

7. The subsea termination assembly according to claim 1, wherein the free portion of the stab pin comprises a landing plate configured to abut against an upper portion of the guide funnel of the receiving subsea structure.

8. The subsea termination assembly according to claim 1, wherein the main body is configured to pivot with respect to the stab pin after the stab pin is inserted into the guide funnel of the receiving subsea structure to fully land on the receiving subsea structure.

9. The subsea termination assembly according to claim 1, wherein the free portion of the stab pin comprises a guide configured to rotationally align the stab pin with the guide funnel of the receiving subsea structure.

10. The subsea termination assembly according to claim 9, wherein the guide of the free portion of the stab pin is disposed between the stabbing end of the stab pin and a landing plate of the free portion of the stab pin, wherein the landing plate of the free portion of the stab pin is configured to abut against an upper portion of the guide funnel of the receiving subsea structure.

11. A method of installing a subsea termination assembly, having a main body, at a subsea location, comprising the following steps:

a) at a floating structure, installing a utility string, which is connected to the main body, in a tensioning system;

b) attaching a free portion of a stab pin to a connected portion of the stab pin, wherein the connected portion of the stab pin is attached to the main body with a hinge assembly, and wherein the attaching comprises:

inserting an insert section into a bore along a central axis of the bore, wherein a first one of the connected portion of the stab pin or the free portion of the stab pin has the insert section, and a second one of the connected portion of the stab pin or the free portion of the stab pin has the bore; and inserting one or more bolts or pins into one or more first securing apertures in the free portion of the stab pin and one or more second securing apertures in the connected portion of the stab pin to block relative movement and separation of the connected portion of the stab pin and the free portion of the stab pin, wherein the one or more first securing apertures are angularly aligned with the one or more second securing apertures;

c) lowering the termination assembly from the floating structure towards the seabed;

d) at the seabed, inserting the stab pin into a guide funnel of a receiving subsea structure; and e) pivoting the main body with respect to the stab pin via the hinge assembly, thus landing the main body onto the receiving subsea structure.

12. The method according to claim 11, wherein the utility string is a subsea umbilical configured to transmit electrical signals and fluid.

13. The method according to claim 11, wherein step c) comprises suspending the subsea termination assembly through a yoke with a lifting eye, wherein the yoke is configured to pivot, with respect to the main body, about the same pivot axis as the stab pin.

14. The method according to claim 11, wherein the one or more bolts or pins extend in a radial direction relative to the central axis of the bore through the one or more first securing apertures in the free portion of the stab pin and the one or more second securing apertures in the connected portion of the stab pin.

15. A subsea termination assembly comprising a main body, a stab pin with a stabbing end configured to be inserted into a guide funnel of a receiving subsea structure to guide the subsea termination assembly during landing on the receiving subsea structure, a hinge assembly connecting the stab pin to the main body in a pivotable manner, and a yoke with a lifting eye;

wherein the hinge assembly comprises a trunnion pin which is attached to the main body, the stab pin and the yoke are connected to the trunnion pin, such that the yoke and the stab pin can pivot about the trunnion pin, wherein the stab pin comprises a free portion comprising the stabbing end, and a connected portion connected to the trunnion pin wherein the subsea termination assembly comprises a stab pin connection arrangement to detachably connect the free portion of the stab pin to the connected portion of the stab pin, wherein the stab pin connection arrangement comprises an insert section disposed within a bore along a central axis of the bore, a first one of the connected portion of the stab pin or the free portion of the stab pin has the insert section, and a second one of the connected portion of the stab pin or the free portion of the stab pin has the bore, wherein the free portion of the stab pin comprises one or more first securing apertures and the connected portion of the stab pin comprises one or more second securing apertures configured to receive one or more bolts or pins to block relative movement and separation of the connected portion of the stab pin and the free portion of the stab pin, and wherein the stab pin comprises one or more alignment features configured to provide angular alignment of the one or more first securing apertures in the free portion of the stab pin and the one or more second securing apertures in the connected portion of the stab pin to enable insertion of the one or more bolts or pins.

16. The subsea termination assembly according to claim 15, wherein the one or more alignment features comprises an alignment notch disposed on the connected portion of the stab pin and an alignment protrusion disposed on the free portion of the stab pin and configured to fit into the alignment notch, wherein the alignment notch and the alignment protrusion are configured to engage one another in an axial direction over an axial distance along the central axis of the bore during axial engagement between the free portion of the stab pin and the connected portion of the stab pin.

17. The subsea termination assembly according to claim 15, wherein the one or more bolts or pins extend in a radial direction relative to the central axis of the bore through the one or more first securing apertures in the free portion of the stab pin and the one or more second securing apertures in the connected portion of the stab pin.

18. The subsea termination assembly according to claim 15, wherein the free portion of the stab pin comprises a landing plate configured to abut against an upper portion of the guide funnel of the receiving subsea structure.

* * * * *